US005944565A

United States Patent [19]

Chadbourne et al.

[11] Patent Number: 5,944,565

[45] Date of Patent: Aug. 31, 1999

[54] ELECTRICAL WEDGE CONNECTOR WITH INSULATION PIERCING WEDGE AND NEST HOUSING

[75] Inventors: Richard Chadbourne, Merrimack; William J Lasko, Littleton; Armand T Montminy, Manchester, all of N.H.

[73] Assignee: Framatome Connectors USA Inc., Fairfield, Conn.

[21] Appl. No.: 09/123,686

[22] Filed: Jul. 28, 1998

[51] Int. Cl.[6] ..... H01R 4/50

[52] U.S. Cl. ..... 439/783

[58] Field of Search ..... 439/783

[56] References Cited

U.S. PATENT DOCUMENTS

| | | | |
|---|---|---|---|
| 3,588,791 | 6/1971 | Polidori | 439/783 |
| 4,415,222 | 11/1983 | Polidori . | |
| 4,730,087 | 3/1988 | Wermer | 439/783 |
| 5,244,422 | 9/1993 | Laricchia | 439/783 |
| 5,538,446 | 7/1996 | Diniz et al. | 439/783 |
| 5,567,186 | 10/1996 | Diniz et al. | 439/783 |
| 5,679,031 | 10/1997 | Chadbourne et al. | 439/783 |
| 5,752,861 | 5/1998 | Cherry et al. | 439/783 |
| 5,842,893 | 12/1998 | De Keyser | 439/783 |

FOREIGN PATENT DOCUMENTS

| | | |
|---|---|---|
| 0810688 | 12/1997 | European Pat. Off. . |
| 2065994 | 7/1981 | United Kingdom . |

OTHER PUBLICATIONS

Malico Catalog, "Waterproof Insulation Piercing ABC Service Connector", pp. 5.2 and 5.3, Oct. 1994.

Malico Catalog, "Anchoring Clamp Malicro Type", p. AS.4, Jun. 1995.

*Primary Examiner*—Neil Abrams
*Assistant Examiner*—J. F. Duverne
*Attorney, Agent, or Firm*—Perman & Green, LLP

[57] ABSTRACT

An electrical wedge connector having a shell and two wedges. The shell has two cross-sectional hook shaped sections orientated generally reverse to each other, but angled relative to each other at an acute angle. One of the wedges has insulation piercers and flaps over conductor contacting surfaces. The other wedge can be trimmed to length and has locking notches to longitudinally lock its relative position with the shell.

19 Claims, 2 Drawing Sheets

ELECTRICAL WEDGE CONNECTOR WITH INSULATION PIERCING WEDGE AND NEST HOUSING

BACKGROUND OF THE INVENTION

1. Field of the Invention

The present invention relates to electrical connectors and, more particularly, to an electrical wedge connector.

2. Prior Art

U.S. Pat. No. 4,415,222 discloses an electrical connector with a C-shape body, a screw-operated wedge, and a conductor interface. U.K. patent application publication No. GB 2065994 discloses a wedge for use in an electrical wedge connector with a cutting edge to cut through insulation on a conductor.

SUMMARY OF THE INVENTION

In accordance with one embodiment of the present invention an electrical wedge connector is provided comprising a shell, a first wedge, and a second wedge. The shell has two cross-sectional hook shaped sections that are acutely angled relative to each other. The first wedge has two conductor contact surfaces on opposite sides of the first wedge. The first and second wedges are adapted to be inserted into the shell adjacent each other to cooperate with the shell for wedging two electrical conductors against the two conductor contact surfaces.

In accordance with another embodiment of the present invention an electrical wedge connector is provided comprising a shell and two wedges. The wedges are sized and shaped to be inserted into the shell with two electrical conductors on opposite sides of a first one of the wedges. The first wedge has two conductor contact surfaces. One of the conductors is located between a second one of the wedges and a first one of the contact conductor surfaces of the first wedge.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
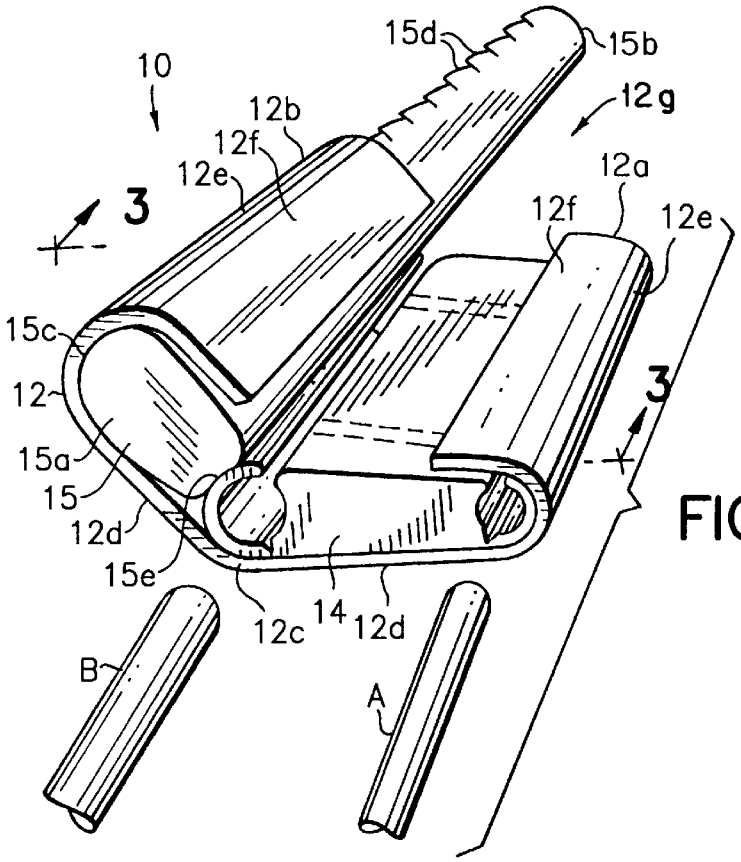
FIG. 1 is a perspective view of an electrical wedge connector incorporating features of the present invention and two electrical conductors shown in exploded view.

Referring to FIG. 1, there is shown an exploded perspective view of an electrical wedge connector 10 incorporating features of the present invention and two electrical conductors A,B. Although the present invention will be described with reference to the single embodiment shown in the drawings, it should be understood that the present invention can be embodied in many alternate forms of embodiments. In addition, any suitable size, shape or type of elements or materials could be used.

The connector 10 comprises a shell 12 and two wedges 14 and 15. The shell 12, in the embodiment shown, is a one-piece metal member. However, in alternate embodiments other materials and/or more than one piece could be used. In this embodiment the shell 12 comprises two sections 12*a*, 12*b*. The first shell section 12*a* has a general cross-sectional hook shape and tapers from the rear end to the front end of the shell. The second shell section 12*b* has a general cross-sectional hook shape and tapers from the rear end to the front end of the shell. The two shell sections 12*a*, 12*b* are connected at a bent section 12*c* and generally reversely orientated relative to each other with, but extend from each other at an acute angle because of the bent section 12*c*. Each hook section is formed by a first long leg 12*d*, a curved section 12*e* and a short leg 12*f*. The two sections 12*a*, 12*b* form in main receiving area 12*g* for receiving the two wedges 14, 15. In this embodiment the acute angle E is about 135°. However, any suitable acute angle less than 180° and more than 90° could be used. Features of the present invention could also be used in a shell that did not have acutely angled hook sections, such as with a tubular shaped shell used with two wedges. In addition, because the second wedge 15 is being used with a wedge shaped shell, the first wedge 14 need not have a wedge shaped profile, but may have a general rectangular profile. However, in alternate embodiments other types of wedge connector shells could be used.

Figure 2:
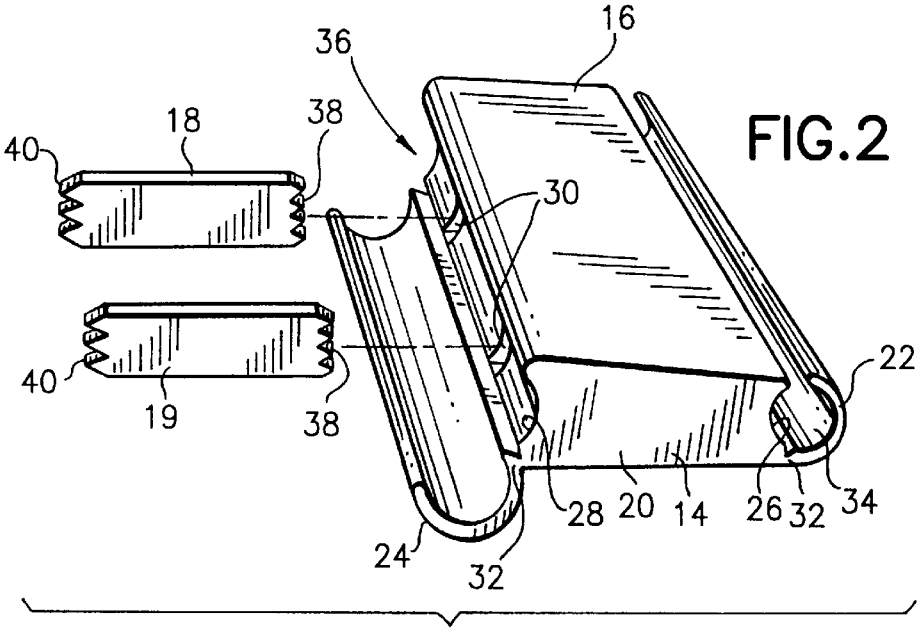
FIG. 2 is an exploded perspective view of the wedge assembly shown in FIG. 1.
Figure 3:
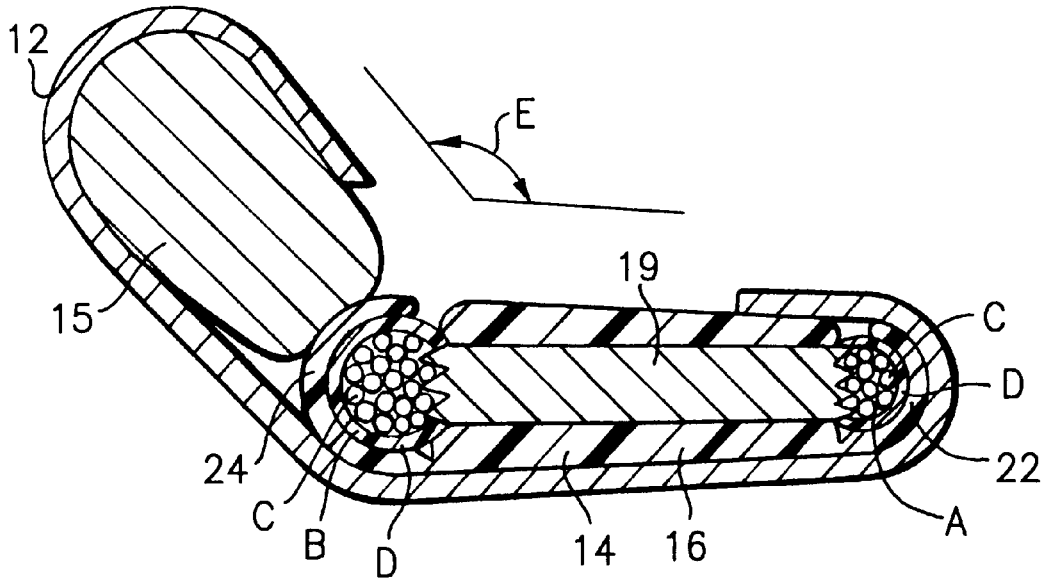
FIG. 3 is a cross-sectional view of the connector and conductors shown in FIG. 1 taken along line 3—3.

Referring also to FIGS. 2 and 3, the first wedge 14 generally comprises a frame 16 and bars 18, 19. In this embodiment the frame 16 is comprised of dielectric material, such as molded plastic or polymer material. The frame 16 comprises a main body section 20 and two flaps 22, 24 on opposite side of the main body section 20. In an alternate embodiment more than two flaps could be provided or only one flap on one side of the main body section need be provided. The main body section 20 includes curved conductor contact surfaces 26, 28 and slots 30 extending between the surfaces 26, 28. The flaps 22, 24 are integrally formed with the main body section 20. However, in an alternate embodiment the flaps could be attached to the main body section rather than integrally formed therewith. In this embodiment a living hinge section 32 connects each of the flaps 22, 24 to the main body section 20. Thus, the flaps 22, 24 extend from the main body section 20 in a general cantilever fashion and can be moved relative to the main body section 20 at the living hinge sections 32. The flaps 22, 24 have a general cross-sectional semi-circular arc shape. The first flap 22 extends over the first conductor contact surface 26. The second flap 24 extends over the second conductor contact surface 28. Thus, two spaces or gaps 34, 36 are formed for receiving the conductors A, B therein, respectively.

The bars 18, 19 are substantially similar, except for their length, and are preferably comprised of electrically conductive metal. Opposite ends of the bars 18, 19 have insulation piercing teeth 38, 40. However, in alternate embodiments other types or numbers of electrically conductive members could be provided on the frame 16. In this embodiment the second flap 24 is folded back and the bars 18, 19 are inserted into the slots 30. In an alternate embodiment the frame 16 could be molded onto the bars 18, 19. The teeth 38, 40 extend out opposite ends of the slots 30 into the conductor receiving spaces 34, 36. The flaps 22, 24 can be folded back at their living hinge connections 32 to insert the conductors A, B into the gaps 34, 36. Then the wedge 14 and conductors A, B are inserted in the shell 12. The second wedge 15 is preferably a one-piece member with an elongate shape that tapers from its rear end 15*a* to its front end 15*b*. The second wedge 15 has a first side 15*c* that is sized and shaped to slide along the inner surface of the curved section 12*e* of the second hook section 12*b*. The first side 15*c* has locking notches 15*d* therealong. The locking notches 15*d* are sized and shaped to interact with the front edge of the shell 12 to interlock the longitudinal position of the second wedge 15 with the shell 12. However, addition, alternative or no longitudinal locking means of the second wedge to the shell could be provided. Additional or alternative locking means could be provided between the two wedges 14, 15. The second wedge 15 also has a second side 15*e* which has an inward longitudinal groove. The groove on the second side 15*e* is sized and shaped to slide along the outer side of the second flap 24 with the flap extending thereinto. In this embodiment the second wedge 15 had a longitudinal length that is longer than the front to rear length of the shell 12. Thus, when the two wedges 14, 15 are inserted into the shell 12, the front end 15*b* of the second wedge 15 extends outward past the front end of the shell 12. The notches 15*d* provide a means or weakness point to allow the front end 15*b* of the second wedge to be broken off of the rest of the second wedge. The notches 15*d* may also be used to latch the wedge 15 to the front edge of the shell 12 to retain the clamping load. In this type of embodiment the front edge of the shell 12 may be formed or bent inward to engage and lock with the notches 15*d* in the wedge 15. In alternative embodiments the length of the second wedge could be about the same as the shell and, thus, no means to break off the front end of the second wedge need be provided. Alternatively, a different type of means to break off or remove the front end of the second wedge could be provided. The long length of the second wedge allows the second wedge to be used with different size first wedges and/or different size conductors A, B. The flaps 22, 24 protect the insulation D on the conductors A, B from being damaged by the shell 12 as the wedges are inserted into the shell. The flaps 22, 24 also push the conductors B, A against the teeth 38, 40 as the flaps are pushed in by the inward wedging action of the shell and second wedge. The teeth 38, 40 are able to pierce through the insulation D on the conductors B, A and make direct electrical contact with the conductive sections C of the conductors. Thus, an electrical connection can be made between two insulated conductors by a wedge connector without first removing the electrical insulation layer and wherein the electrical connection is not made through the shell. However, in an alternate embodiment, electrical connection could also be made through the shell. In this embodiment, the first wedge 14 is positioned in its intended final position in the shell 12 and then the second wedge is wedged into the space between the shell and the first wedge.

Figure 4:
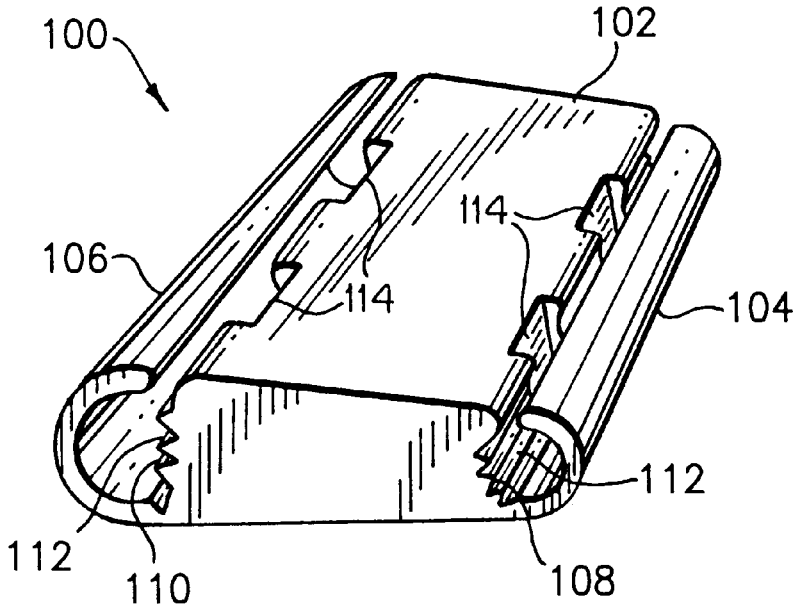
FIG. 4 is a perspective view of an alternate embodiment of the wedge.

Referring now to FIG. 4, an alternate embodiment of the wedge is shown. In this embodiment the wedge 100 is a one-piece member comprised of an electrically conductive material, such as aluminum. The wedge 100 has a main body 102 and two flaps 104, 106. The main body 102 has the two flaps 104, 106 formed integrally therewith, such as by means of an extrusion process. The main body 102 has two conductor contact surfaces 108, 110. The surfaces 108, 110 have teeth 112 therealong and recessed areas 114. The recessed areas 114 are provided to reduce the area of contact at the surfaces 108, 110 so that the teeth 112 can more easily pierce through insulation on the conductors. With this type of embodiment the wedge does not need separate insulation piercing members. The present invention could also be used in a wedge connector where the first wedge did not have flaps on both sides and/or where the first wedge is not an insulation piercing wedge assembly.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a shell having a main receiving area with two cross-sectional hook shaped sections which are acutely angled relative to each other;

a first wedge movably positionable in the main receiving area and having two conductor contact surfaces on opposite sides of the first wedge; and a second wedge movably positionable in the main receiving area, wherein the first and second wedges are adapted to be inserted into the shell adjacent each other to cooperate with the shell for wedging two electrical conductors against the two conductor contact surfaces.

2. A wedge connector as in claim 1 wherein the first wedge has a first flap extending over a first one of the conductor contact surfaces with a first conductor receiving area being formed between the first flap and the first conductor contact surface.

3. A wedge connector as in claim 2 wherein the first wedge has a main body with the conductor contact surfaces thereon and the first flap is movable relative to the main body.

4. A wedge connector as in claim 3 wherein the flap is formed integral with the main body.

5. A wedge connector as in claim 2 wherein the first wedge has a second flap extending over a second one of the conductor contact surfaces with a second conductor receiving area being formed between the second flap and the second conductor contact surface.

6. A wedge connector as in claim 5 wherein the first wedge has a main body with the conductor contact surfaces and the first and second flaps being formed integral with the main body.

7. A wedge connector as in claim 6 wherein the main body and flaps are comprised of dielectric plastic material.

8. A wedge connector as in claim 7 wherein the first wedge further comprises an electrically conducting bar mounted in the main body and having opposite ends which project past the conductor contact surfaces.

9. A wedge connector as in claim 1 wherein the second wedge has a longitudinal length longer than a longitudinal length of the shell, and wherein a front end of the second wedge is adapted to be broken off of the rest of the second wedge.

10. A wedge connector as in claim 1 wherein the second wedge has means for locking longitudinal position of the second wedge relative to the shell.

11. An electrical wedge connector comprising:

a shell; and two wedges sized and shaped to be inserted into the shell with two electrical conductors on opposite sides of a first one of the wedges, the first wedge having two conductor contact surfaces, wherein one of the conductors is located between a second one of the wedges and a first one of the conductor contact surfaces of the first wedge.

12. A connector as in claim 11 wherein the shell has two cross-sectional hook shaped sections which are generally reversely oriented relative to each other and angled at an acute angle relative to each other.

13. A wedge connector as in claim 11 wherein the first wedge has a first flap extending over the first conductor contact surface with a first conductor receiving area being formed between the first flap and the first conductor contact surface.

14. A wedge connector as in claim 13, wherein the first wedge has a main body with the conductor contact surfaces thereon and the first flap is movable relative to the main body.

15. A wedge connector as in claim 14 wherein the flap is formed integral with the main body.

16. A wedge connector as in claim 13 wherein the first wedge has a second flap extending over a second one of the conductor contact surfaces with a second conductor receiving area being formed between the second flap and the second conductor contact surface.

17. A wedge connector as in claim 11 wherein the first wedge has a main body comprised of dielectric plastic material and an electrically conducting bar mounted in the main body and having opposite ends which project past the conductor contact surfaces.

18. A wedge connector as in claim 11 wherein the second wedge has a longitudinal length longer than a longitudinal length of the shell, and wherein a front end of the second wedge is adapted to be broken off the rest of the second wedge.

19. A wedge connector as in claim 11 wherein the second wedge has means for locking longitudinal position of the second wedge relative to the shell.

* * * * *